US012643764B2

(12) United States Patent
Shirley et al.

(10) Patent No.: US 12,643,764 B2
(45) Date of Patent: Jun. 2, 2026

(54) OPTICAL FIBER PAY-OFF SYSTEM AND OPTICAL FIBER PROOF TEST SYSTEM

(71) Applicant: DRAKA COMTEQ FRANCE SAS, Paron (FR)

(72) Inventors: Paul Shirley, Paron (FR); Nelly Montaigne, Paron (FR); Bernard Cailleret, Paron (FR)

(73) Assignee: DRAKA COMTEQ FRANCE SAS, Paron (FR)

( * ) Notice: Subject to any disclaimer, the term of this patent is extended or adjusted under 35 U.S.C. 154(b) by 398 days.

(21) Appl. No.: 18/068,214

(22) Filed: Dec. 19, 2022

(65) Prior Publication Data

US 2023/0202795 A1 Jun. 29, 2023

(30) Foreign Application Priority Data

Dec. 27, 2021 (IT) ..... 102021000032675

(51) Int. Cl.
*B65H 54/28* (2006.01)
*B65H 57/00* (2006.01)
(Continued)

(52) U.S. Cl.
CPC ..... *B65H 54/2884* (2013.01); *B65H 57/006* (2013.01); *B65H 57/14* (2013.01);
(Continued)

(58) Field of Classification Search
CPC ..... B65H 54/2884; B65H 54/2887; B65H 57/006; B65H 57/28; B65H 57/18;
(Continued)

(56) References Cited

U.S. PATENT DOCUMENTS 2,988,292 A * 6/1961 Bliss ..... B65H 54/2872 242/478.2
3,565,357 A * 2/1971 Noguchi ..... B65H 54/2872 242/413.4
(Continued)

FOREIGN PATENT DOCUMENTS

CN 109132695 A 1/2019
CN 109179068 A * 1/2019 ..... B65H 54/28
(Continued)

*Primary Examiner* — Victoria P Augustine
*Assistant Examiner* — Nathaniel L Adams
(74) *Attorney, Agent, or Firm* — Slater Matsil, LLP

(57) ABSTRACT

An optical fiber pay-off system includes a draw spool around which an optical fiber is wound and defining a longitudinal axis; a pay-off arm movable parallel to the longitudinal axis and engaged with a pay-off portion of the optical fiber; a controller configured to receive first and second position signals and instructs the pay-off arm to selectively move in a first direction and in an opposite second direction; first and second proximity sensors mounted on the pay-off arm; a tilting support rotatably mounted on the pay-off arm. The system further includes an activation body fixed to the tilting support and extending between the first and second proximity sensors to be selectively detected by the sensors according to positions assumed by the tilting support. The system further includes first and second contacts fixed to the tilting support and defining an intermediate space in which the pay-off portion can move.

20 Claims, 6 Drawing Sheets

(51) Int. Cl.
*B65H 57/14* (2006.01)
*B65H 57/28* (2006.01)
*B65H 59/40* (2006.01)

(52) U.S. Cl.
CPC ..... *B65H 57/28* (2013.01); *B65H 59/40* (2013.01); *B65H 2701/32* (2013.01)

(58) Field of Classification Search
CPC B65H 54/28; B65H 54/2818; B65H 54/2827; B65H 54/30
See application file for complete search history.

(56) References Cited

U.S. PATENT DOCUMENTS

| | | | | | |
|---|---|---|---|---|---|
| 4,022,391 | A * | 5/1977 | Stein | B65H 54/2872 | 242/478.2 |
| 4,179,083 | A * | 12/1979 | Hara | B65H 54/2851 | 242/478.2 |
| 4,373,686 | A * | 2/1983 | Milli | B65H 54/28 | 242/483.3 |
| 2019/0010013 | A1 * | 1/2019 | Suzuki | G02B 6/4458 | |
| 2019/0039856 | A1 * | 2/2019 | Summer | B65H 75/425 | |
| 2020/0087102 | A1 | 3/2020 | Russell et al. | | |

FOREIGN PATENT DOCUMENTS

| | | | |
|---|---|---|---|
| WO | 0235210 | A1 | 5/2002 |
| WO | 2016128784 | A1 | 8/2016 |

* cited by examiner

OPTICAL FIBER PAY-OFF SYSTEM AND OPTICAL FIBER PROOF TEST SYSTEM

CROSS-REFERENCE TO RELATED APPLICATIONS

This application claims priority to Italian Application No. 102021000032675, filed on Dec. 27, 2021, which application is hereby incorporated herein by reference.

TECHNICAL FIELD

The present disclosure relates to an optical fiber pay-off system and particularly but not limitatively, a proof test machinery.

BACKGROUND

As it is known, an optical fiber is obtained by producing a primary preform (or core rod), overcladding the primary preform and drawing it to form the optical fiber. For ease of handling and shipping, the optical fiber is then wound onto a spool at high speed.

Fiber production also includes a testing phase to ensure that the fibers meet the requirements set on them by cable production. One of the tests conducted on fibers is the proof test having the purpose of ensuring that the fiber sustains the tensile stress to which is may be subjected during cable production or cable installation.

In the proof test machine, the optical fiber is first guided at high speed to an input pulling device and further to an output pulling device and then onto the shipping spool. The input and output pulling devices subject the optical fiber to a predefined value of tensile stress, as a result of which the fiber breaks if the fiber strength is insufficient.

Document WO2016/128784 describes a method for controlling rotation of a winding spool of proof test machine for optical fibers which provides for a fiber accumulation zone adapted to accumulate a predetermined fiber length preventing that a fiber broken end resulting from the break going beyond the input point of the winding spool.

Document WO2002/35210 discloses a proof-testing machine for optical fiber wherein the fiber end is guided in the case of break between the first and the second pulling device by means of a channel, which guides the fiber to the second pulling device.

It is noticed that the fiber to be tested is fed to the proof test machine by unwinding it from a draw spool around which the fiber is wound.

Typically, proof-test is carried out on an optical fiber formed by a core, a cladding and a buffer, i.e. on the fiber as obtained before the application of a jacket. In some cases, the buffer is coated with a dye or ink to make the fiber assuming a specific color. Such color allows distinguishing each fiber and its function among other fibers in an optical cable. The color of an optical fiber buffer can be chosen among several possible colors (e.g. up to thirteen colors) and includes: white, red, black.

According to a known machine, the fiber unwinding is performed by a pulley mounted on a pay-off arm which guide the fiber along the draw spool by moving from left to right to follow the winding. According to this known machine, two optical sensors detect the fiber passing in front of them and in consequence activate a motor to move the pay-off arm from left to right and vice versa. More particularly, when the fiber is detected by one optical sensor the winding arm is moved by a predetermined amount so that the fiber essentially is re-centerd between the two optical sensors. As the fiber naturally unwinds along the draw spool, the fiber angle between the fiber and the pulley increases until such time as the sensor detects the fiber and the system moves the winding arm again to re-center the fiber between the two optical sensors. Said optical sensors are of the type based on reflected light and include an emitter and a receiver placed in the same housing.

The optical sensor has a behavior depending on the reflective surface and, particularly, on the color of the optical fiber buffer, which may influence the detection capability. Therefore, the sensor can include an adjustment optical module (i.e. additional optical component, such as one or more lenses) that makes it suitable for reflective light having frequency different from the one for which the sensor is configured. However, the use of the optional adjustment optical module is often not practical in optical fiber pay-off system, where it would require several adjustments in a day.

SUMMARY

The Applicant observes that the known optical fiber pay-off arms, employing optical sensors detecting the fiber passage, do not show a satisfying use flexibility and require excessive maintenance activity. Particularly, the adjustment optical module has to be re-configured or changed as an optical fiber with different color has to be detected. Furthermore, according to another possible situation, the adjustment optical module can be damaged over time (e.g. from loose fiber after a break) and therefore its readjusting or substitution is necessary.

The Applicant has found that a pay-off arm provided with a tilting support rotatable under a corresponding action of the fiber optic to be unwound and having an activation body which can be selectively detected by two proximity sensors shows performances independent from the optical fiber colors.

According to a first aspect, the present disclosure relates to an optical fiber pay-off system comprising a draw spool around which an optical fiber is wound and defining a longitudinal axis; a pay-off arm movable parallel to said longitudinal axis and engaged with a pay-off portion of the optical fiber; a controller configured to receive first and second position signals and instruct said pay-off arm selectively moving in a first direction and in an opposite second direction; a first and second proximity sensors mounted on said pay-off arm; a tilting support rotatably mounted on said pay-off arm; an activation body fixed to said tilting support and extending between said first and second proximity sensors to be selectively detected by said sensors according to positions assumed by the tilting support; a first and a second contacts fixed to said tilting support and defining an intermediate space in which the pay-off portion can move; wherein the tilting support is rotatable under a corresponding action of the pay-off portion on said first and second contacts and configured to selectively assume: a first detection position in which the activation body is detected by the second proximity sensor which generates a position signal, and a second detection position in which the activation body is detected by the first proximity sensor which generates a further position signal.

In an embodiment, said proximity sensors respectively include a sensor device selected from the group: inductive sensor, optical sensors, capacitive sensors, magnetic sensors.

In an embodiment, said controller is configured to alternatively receive the position signal and the further position signal and instruct said pay-off arm to selectively move in the first direction and in the opposite second direction in order to reach a position in which the activation body is not detected by either first proximity sensor and second proximity sensor.

In an embodiment, said system further includes a base structure supporting the first and second proximity sensors and the tilting support. In an embodiment, said pay-off arm comprises: a movable slip arranged to be translated parallel to said longitudinal axis; said base structure being mechanically connected to said movable slip; at least a first pulley mechanically connected to the movable slip to guide an unwinding of said pay-off portion from the draw spool.

In an embodiment, the system further comprises a move assembly configured to move the movable pay-off arm in said first and second directions and having: a linear actuator connected to said slip; a motor mechanically connected to said linear actuator to move the slip and configured to be controlled by said controller.

In an embodiment, said base structure comprises a support plate on which the tilting support and the first and second proximity sensors are fixed and a connection plate mechanically connected to said slip. In an embodiment, said tilting support comprises: a pivot fixed to said base structure and a rotatable pad mounted to said base structure by said pivot.

In an embodiment, said activation body is rod shaped and extends from a first side portion of the rotatable pad towards a gap region formed between the first and second proximity sensors; said first and second contact bodies are rod shaped and extend from a second side portion of the rotatable pad separated from said first side portion by the pivot.

In an embodiment, the system is configured to operate as proof test system of said optical fiber and further comprises: a test apparatus configured to subject the optical fiber unwound from the draw spool to a proof test procedure; a take-up apparatus configured to wound the optical fiber exiting the test apparatus onto a shipping spool.

In an embodiment said test apparatus comprises: an input capstan provided by a first drive motor and an output capstan provided by a second drive motor and a plurality of intermediate pulleys; wherein: the input capstan, the plurality of intermediate pulleys and the output capstan are configured to guide the optical fiber and apply a force to the optical fiber depending from rotation velocities of said output capstan and said input capstan.

In an embodiment, said test apparatus further comprises: a load cell configured to measure a tension value associated with optical fiber in the test apparatus.

In an embodiment, said the test apparatus further comprises: a fiber break cell configured to detect a break of the optical fiber and send corresponding break detection signal to the controller; the controller being configured to initiate a stop of the movement of the optical fiber towards the take-up apparatus on the basis of said break detection signal.

In an embodiment, said take-up apparatus comprises: a movable take-up arm which is configured to be engaged with the optical fiber and move parallel to a further longitudinal axis defined by said shipping spool. In an embodiment, the system further comprises: an anti-whipping assembly having at least one accumulator pulley (37) guiding the optical fiber exiting the output capstan.

According to another object, the present disclosure relates to a position detection device comprising: a base structure; a first proximity sensor and a second proximity sensor mounted on said base structure; a tilting support rotatably mounted on said base structure; an activation body fixed to said tilting support and extending between said first and second proximity sensors to be selectively detected by said sensors according to positions assumed by the tilting support; a first and a second contacts fixed to said tilting support and defining an intermediate space in which a fiber optic portion can move; wherein the tilting support is rotatable under a corresponding action of the optical fiber portion on said first and second contacts and is configured to selectively assume: a first detection position in which the activation body is detected by the second proximity sensor, and a second detection position in which activation body is detected by the first proximity sensor.

BRIEF DESCRIPTION OF THE DRAWINGS

Further characteristics and advantages will be more apparent from the following description of the various embodiments given as a way of an example with reference to the enclosed drawings in which.

DETAILED DESCRIPTION OF ILLUSTRATIVE EMBODIMENTS

Figure 1:
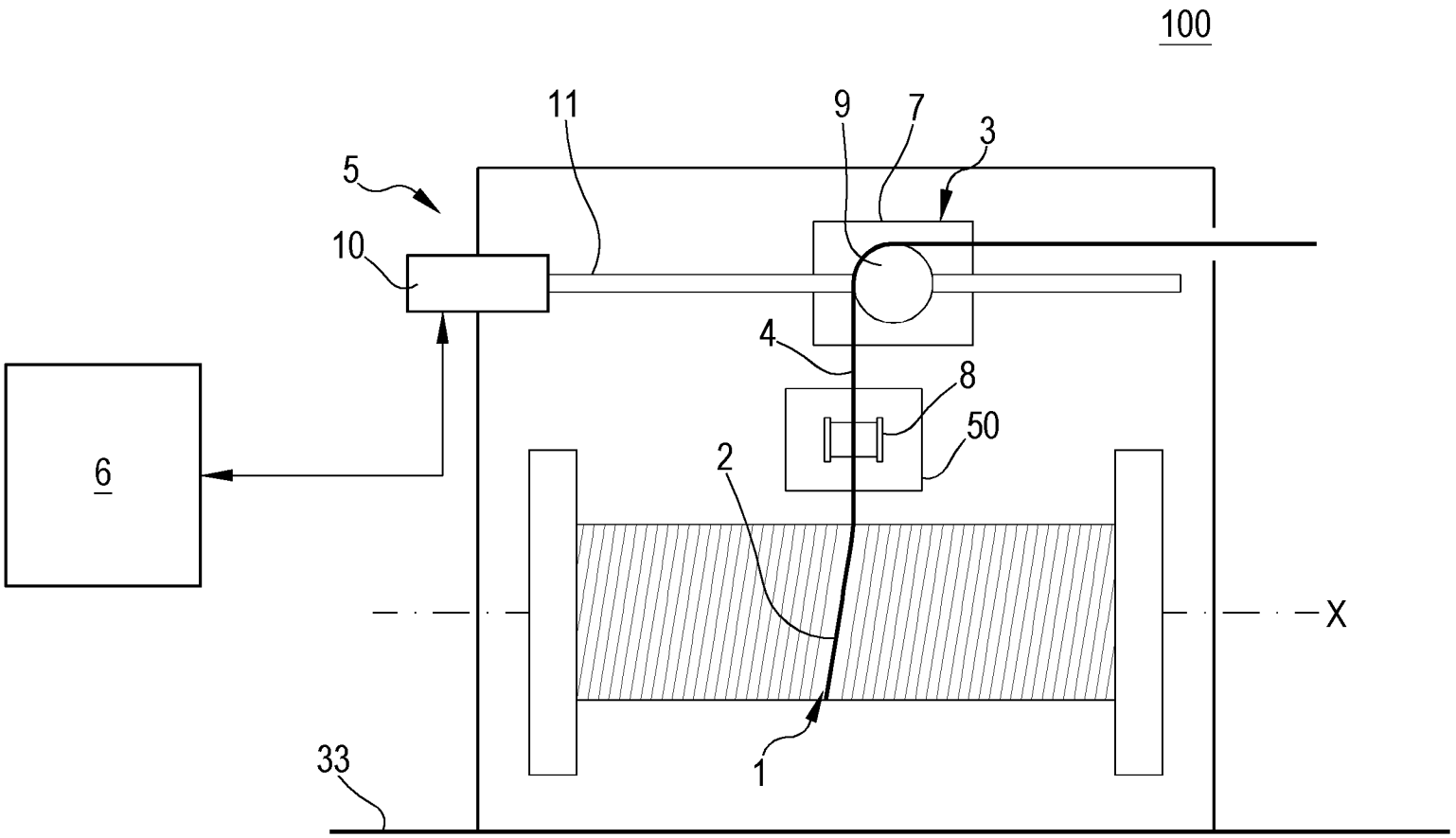
FIG. 1 schematically shows an optical fiber pay-off apparatus according to an example.

FIG. 1 schematically shows an optical fiber pay-off system 100 comprising a draw spool 1, an optical fiber 2, wound around the draw spool 1, and a movable pay-off arm 3. Particularly, the draw spool 1 defines a longitudinal axis X. The movable pay-off arm 3 is configured to be engaged with a pay-off portion 4 of the optical fiber 2 and is movable parallel to said longitudinal axis according to a first direction (e.g. from left to right) or an opposite second direction (e.g. from right to left).

Particularly, optical fiber pay-off system 100 comprises a move assembly 5 configured to control a movement of the movable pay-off arm 3 in the first direction or in the second direction. The move assembly 5 is connected to a controller 6 which is configured to control parameters characterizing the operation of the move assembly 5 and therefore the movement of the movable pay-off arm 3.

The controller 6 can be a computer comprising a non-volatile memory (e.g. a read-only memory (ROM) or a hard disk), a volatile memory (e.g. a random access memory or RAM) and a processor (components not shown). The non-volatile memory is a non-transitory computer-readable carrier medium storing executable program code instructions.

As an example, the optical fiber 2 can be a known optical fiber such as a multi-mode optical fiber, a single mode optical fiber or a special-purpose optical fiber. Particularly, the optical fiber 2 has a core, a cladding and a buffer and, more particularly, it is not yet provided with a covering jacket (elements not shown).

According to an embodiment, the buffer is coated with a dye or ink to make the optical fiber 2 assuming a specific color. As it is known, a color allows distinguishing each fiber and its function among other fibers in an optical cable.

According to an embodiment, the buffer comprises two layers, a primary coating and a secondary coating. The secondary coating is the external layer of the buffer. In some embodiments, the secondary coating is coated with a dye or ink to make the optical fiber 2 assuming a specific color. In other embodiments, the secondary coating is made of a material, such as a resin, wherein a coloring additive is included.

The color of an optical fiber buffer can be chosen among several possible colors (e.g. up to thirteen colors) and includes, as an example: white, red, black, blue, brown, green, grey, orange, aqua, rose, violet, yellow.

According to an example, the movable pay-off arm 3 comprises a slip 7 and at least a first pulley 8 mechanically connected to the slip 7. In accordance with such example, the first pulley 8 is rotatable around an axis parallel to the longitudinal axis X. Particularly, the movable pay-off arm 3 is also provided with a second pulley 9 mechanically connected to the slip 7 and rotatable around an axis perpendicular to the longitudinal axis X.

In accordance with an example, the move assembly 5 comprises a motor 10 connected to a linear actuator, such as an example, a ball screw, comprising a screw 11 (or another guide) on which the slip 7 can translate.

Figure 2:
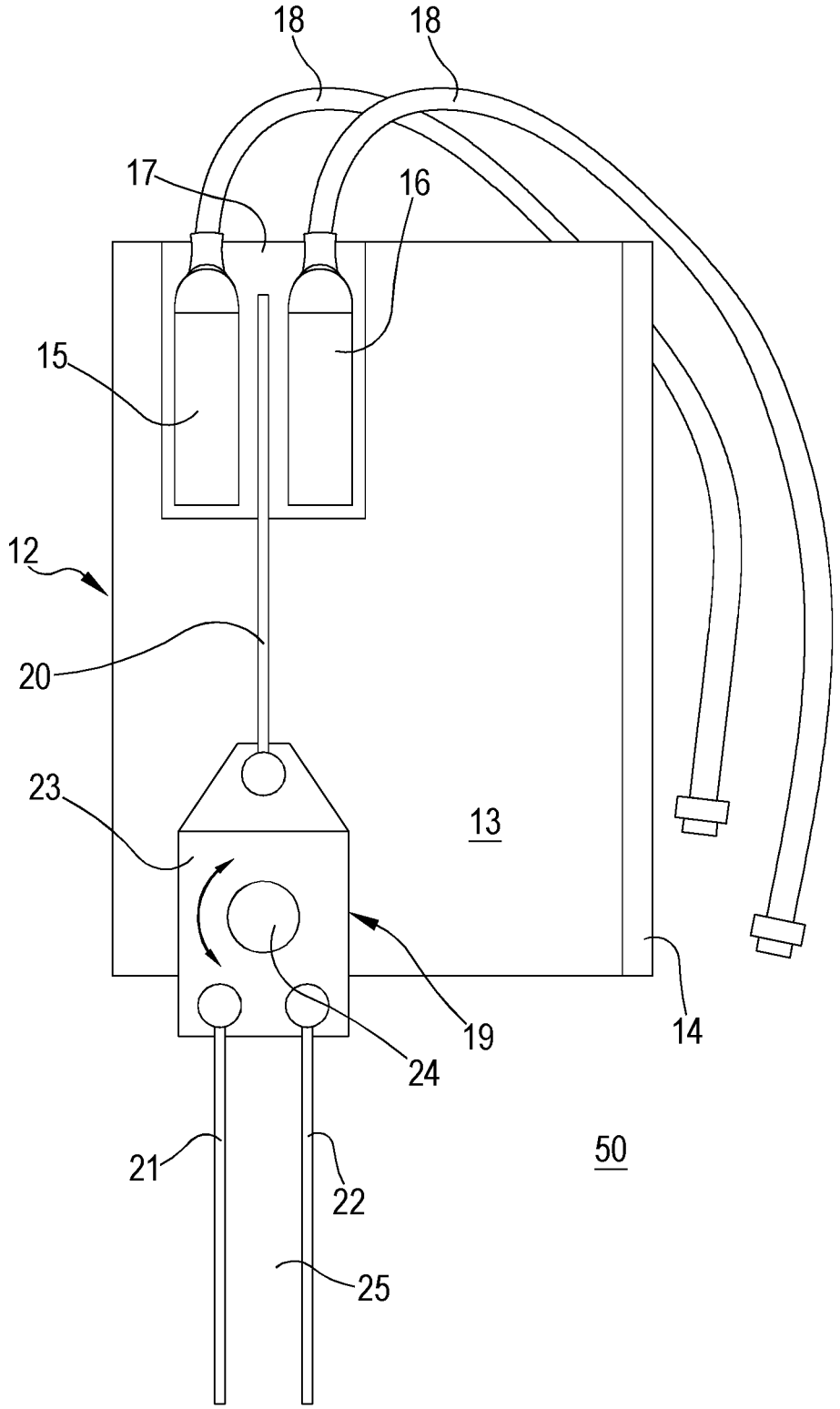
FIG. 2 shows an example of a position detection device employable in said optical fiber pay-off apparatus.

Moreover, the optical fiber pay-off system 100 comprises a position detection device 50, only schematically represented in FIG. 1. FIG. 2 shows an embodiment of said position detection device 50 comprising a base structure 12 to be mechanically connected to the pay-off arm 3 and particularly to the slip 7.

As an example, the base structure 12 includes a support plate 13 fixed to a transversal (e.g. perpendicular) connection plate 14 to be mechanically coupled to the slip 7 of the movable pay-off arm 3. A first proximity sensor 15 and a second proximity sensor 16 are mounted on said support plate 13 so as to be separated by a gap region 17.

The first proximity sensor 15 and the second proximity sensor 16 may include a respective inductive sensor which, as known, operates by electromagnetic induction to detect an object. The first proximity sensor 15 and the second proximity sensor 16 are connected to respective cables 18 for carrying signals generated by the proximity sensors. Alternatively to the inductive sensors, other type of proximity sensors can be employed, such as: optical sensors, capacitive sensors, magnetic sensors. (To be checked.

Moreover, the position detection device 50 is provided with a tilting support 19 rotatably mounted on said support plate 13 to which an activation body 20, a first contact 21 and a second contact 22 are fixed. The tilting support 19 comprises a rotatable pad 23 rotatable fixed to the support plate 13 by a pivot 24. At a first portion end of the rotatable pad 23 the activation body 20 is fixed, which can be, as an example, a rod or a bar that extends up to the gap region 17 formed between the first proximity sensor 15 and the second proximity sensor 16. The activation body 20 is made by a material (as an example, stainless steel) that can be detected by the first proximity sensor 15 and the second proximity sensor 16 when the activation body 20 is in a corresponding detection range.

The first contact 21 and the second contact 22 are fixed to a second portion end of the rotatable pad 23. Particularly, the first portion end and the second portion end of the rotatable pad 23 are on opposite sides with respect to the pivot 24. Particularly, the first contact 21 and the second contact 22 are under the form of corresponding bars extending parallel each other, and in a direction opposite to the extending direction of the activation body 20.

The first contact 21 and the second contact 22 define an intermediate space 25 wherein the pay-off portion 4 of the optical fiber 2 can move during a pay-off procedure. As visible from FIGS. 3 and 4 and 5 (showing part of the pay-off arm 3), the first pulley 8, the gap region 17 and the intermediate space 25 have respective center lines included into a plane perpendicular to the longitudinal axis X, when the tilting support 19 is not subject to a contact action by the pay-off portion 4 of the optical fiber 2.

Figure 3:
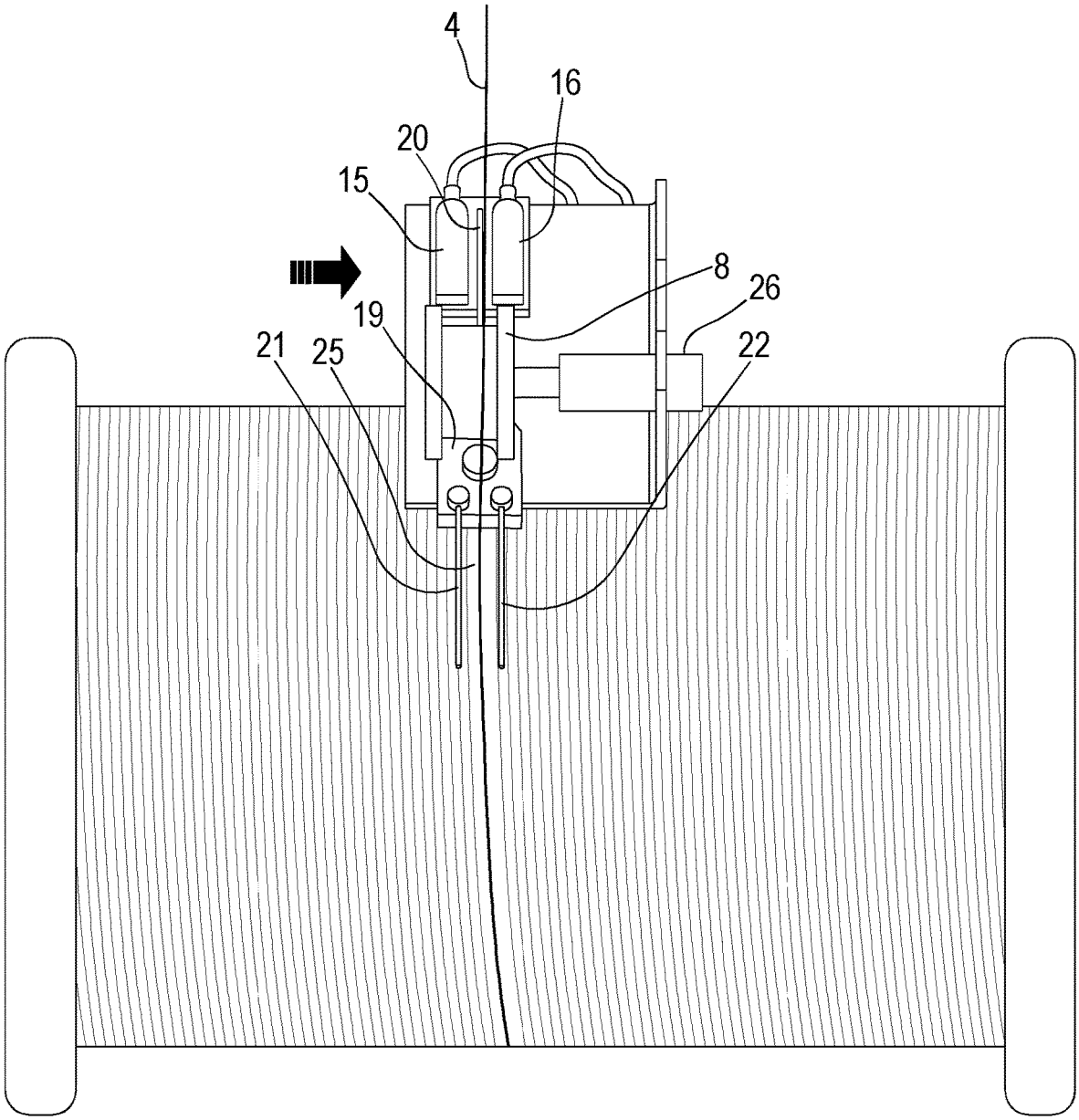
FIG. 3 shows a first operative configuration of said position detection device.
Figure 4:
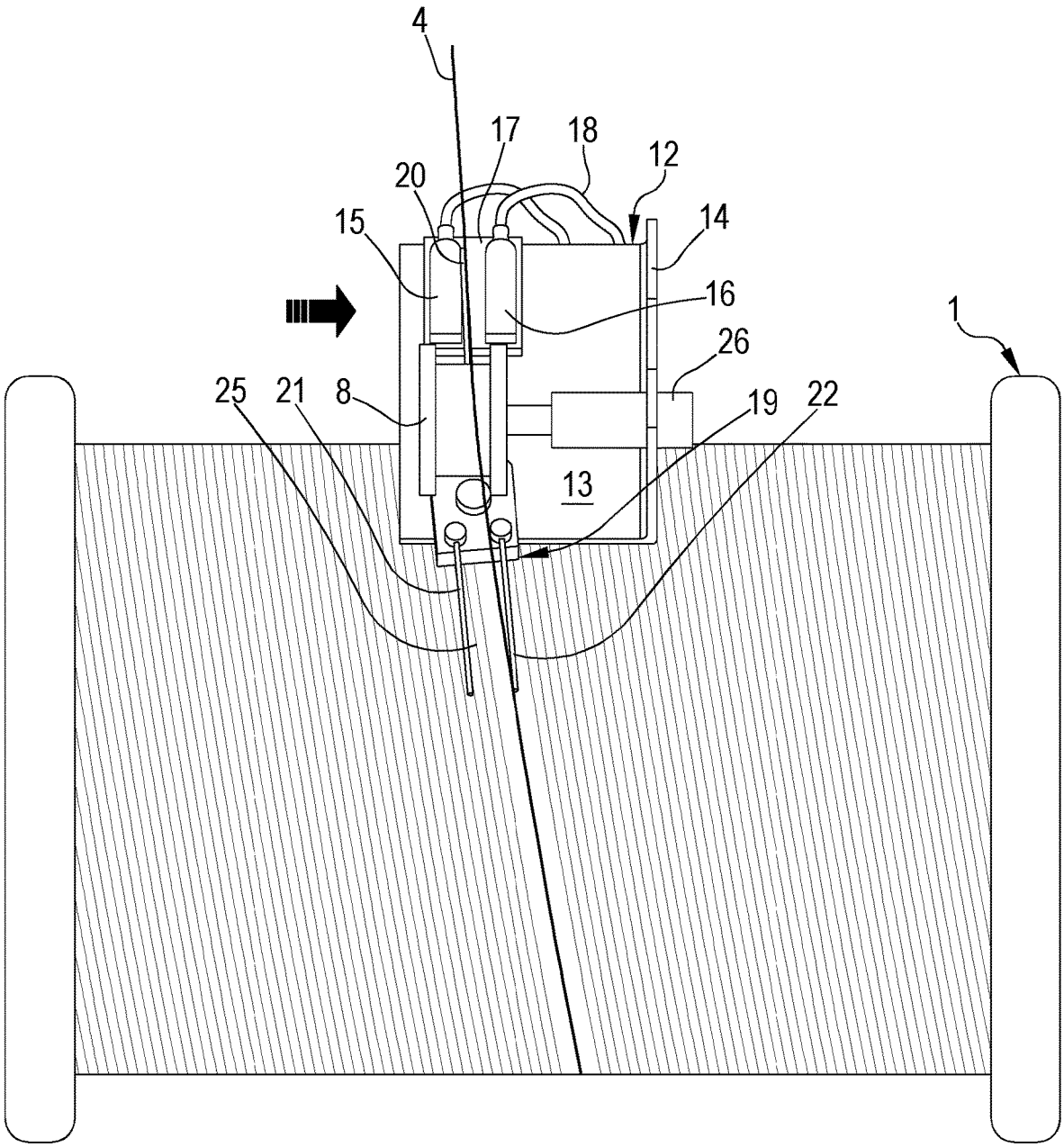
FIG. 4 shows a second operative configuration of said position detection device.
Figure 5:
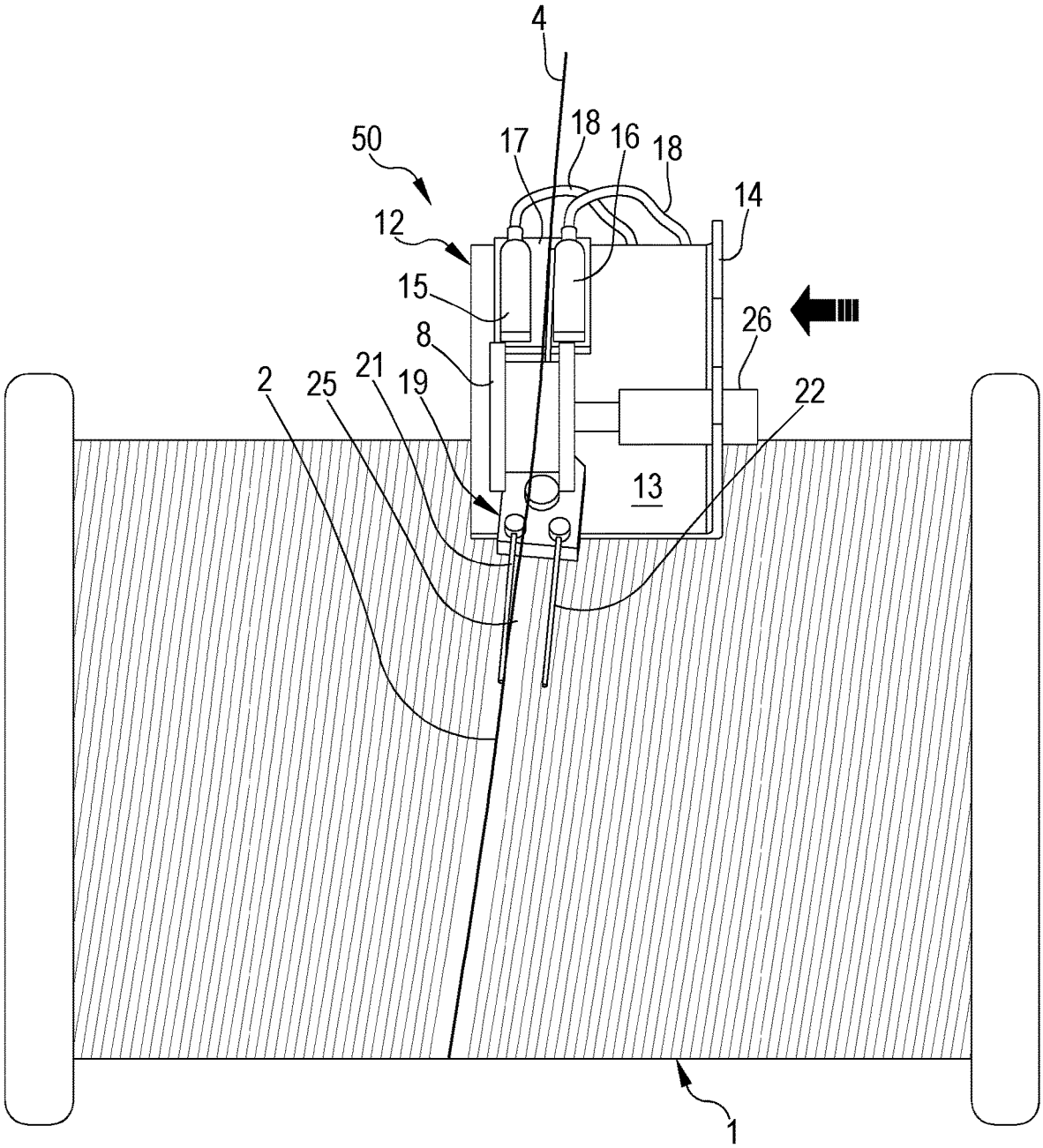
FIG. 5 shows a third operative configuration of said position detection device.

FIGS. 3-5 also show a further motor 26 optionally provided to rotate the first pulley 8 for facilitating the unwinding of the optical fiber 2 from the draw spool 1.

An example of operation of the pay-off system 100 is described hereinbelow. According to said example, the controller 6 is configured to instruct, via the motor 10, a movement of the pulley 8 of the pay-off arm 3 along the screw 11 only when the activation body 20 is detected by the first proximity sensor 15 or the second proximity sensor 16.

FIG. 3 shows the situation in which the activation body 20 is substantially aligned with the center line of the of the gap region 17 and is not detected by either first proximity sensor 15 and second proximity sensor 16. In accordance with the described example, in this situation the controller 6 does not activate the motor 10 and the first pulley 8 of the pay-off arm 3 in not moved along the screw 11.

As shown in FIG. 4, while the unwinding occurs the pay-off portion 4 of the optical fiber 2 comes into contact with the second contact 22 because of an inherent winding angle assumed by the pay-off portion 4 or a change in the winding direction around the draw spool 1. The change of winding occurs, as an example, when the optical fiber 2 reaches the end side (e.g. the left side) of the draw spool 1. Due to the physical contact of the pay-off portion 4 on the second contact 22, the tilting support 19 rotates counterclockwise and therefore the activation body 20 enters the detection region of the first proximity sensor 15. The first proximity sensor 15 detects presence of the activation body 20 and generates a corresponding first detection signal that is received by the controller 6, via the cable 18.

On the basis of the first detection signal, the controller 6 generates a command signal which is provided to the motor 10 so as to generate a control signal to cause a motion of the pay-off arm 3 of a preestablished amount in order to re-establish the condition shown in FIG. 3 in which the activation body 20 is substantially aligned with the center line of the of the gap region 17.

In greater detail, the slip 7, supporting the first pulley 8 and the second pulley 9, starts moving from left to right so following the optical fiber 2 due to the action of the motor 10 on the screw 11. The pay-off portion 4 of the optical fiber 2 assume again the position shown in FIG. 3. FIG. 5 refers to the situation in which, as an example, starting from the configuration of FIG. 3 or FIG. 4, the pay-off portion 4 of the optical fiber 2 comes into contact with the first contact 21 because of the inherent winding angle or another change in the winding direction around the draw spool 1. As an example, the optical fiber 2 reaches the right side of the draw spool 1. Due to the physical contact of the pay-off portion 4 on the first contact 21, the tilting support 19 rotates clockwise and therefore the activation body 20 enters the detection region of the second proximity sensor 16. The second proximity sensor 16 detects the presence of the activation body 20 and generates a corresponding second detection signal that is received by the controller 6.

The controller 6 generates another command signal which is provided to the motor 10 so as to cause a motion of the pay-off arm 3 of the preestablished amount in a direction opposite to the previous described one. Therefore, the slip 7, supporting the first pulley 8 and the second pulley 9, starts moving from right to left so following the optical fiber 2. The pay-off portion 4 of the optical fiber 2 assume again the position shown in FIG. 3 and the motor 10 is deactivated. It is noticed that the above described pay-off system 100 employing the position detection device 50 allows unwinding the optical fiber 2 from the draw spool 1 without any human intervention and without damaging the coating of the optical fiber.

Figure 6:
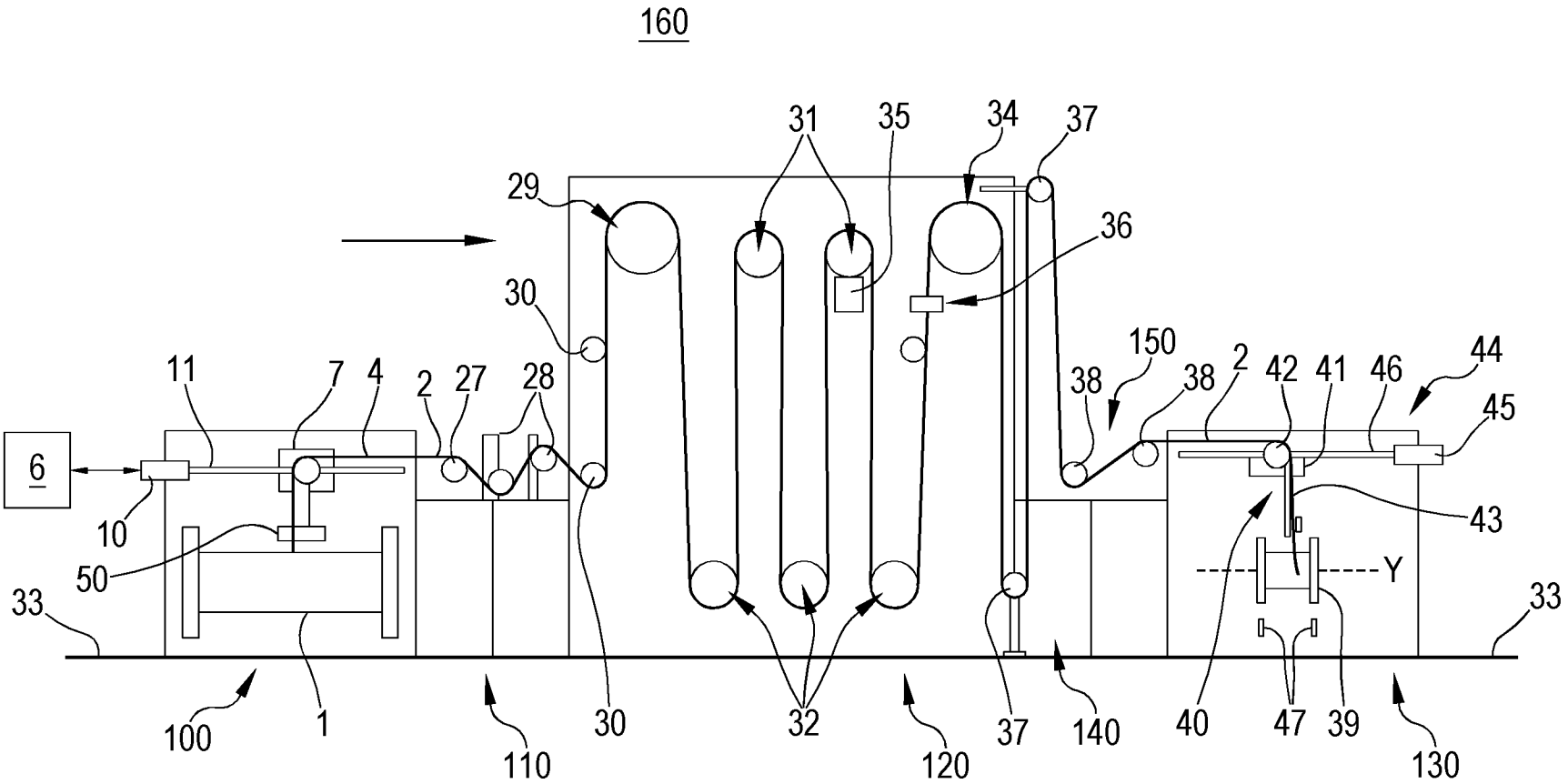
FIG. 6 schematically shows a proof test system comprising said optical fiber pay-off apparatus.

According to a preferred embodiment, the optical pay-off system 100 can be employed, not exclusively, in a proof test system 160, as the one schematically represented in FIG. 6.

FIG. 6 shows an example of the proof test system 160 comprising the optical fiber pay-off system 100 (analogous or identical to that above described), a dancer assembly no, a test apparatus 120 and a take-up apparatus 130. Particularly, the proof test system 160 lies on a horizontal base 33 and is configured to operate under the control of the controller 6.

The dancer assembly 110 comprises at least one fixed pulley 27 and at least one position adjustable pulley 28 that guide the optical fiber 2, unwound from the draw spool 1, towards the proof test apparatus 120. As an example, two position adjustable pulleys 28 are employed. Moreover, the dancer assembly 110 is configured to set a suitable tension between the draw spool 1 and an input capstan 29 of the test apparatus 120 by a fixed weight. The positions of the adjustable pulleys 28 are adjusted by the controller 6 to correctly synchronize the speed of the motor 10 and/or the further motor 26 (if adopted) with that of the input capstan 29.

As an example, the test apparatus 120 is provided with at least one input pulley 30, the already mentioned input capstan 29, a plurality of upper pulleys 31, a plurality of lower pulleys 32 and an output capstan 34. Particularly, the input capstan 29 and the output capstan 34 are positioned at a same high from the horizontal base 33, greater than the high at which the dancer assembly 110 is positioned. The upper pulleys 31 are arranged, according to an example, at the same high of the input capstan 29, while the lower pulleys 32 are placed at lower level, such as the one of the longitudinal axis X of the draw spool 1.

The input capstan 29 is configured to draw the optical fiber 2 into the test apparatus 120 and is provided with a respective drive motor (not shown) which operates according to a line speed set point provided by the controller 6. Particularly, a numerical counter (not shown), used to count the length of the portion of the optical fiber 2 which is submitted to the test, is arranged between the input capstan 29 and the corresponding drive motor.

The proof test system 160 provides a path for the optical fiber 2 comprising: the input capstan 29 followed by a sequence including lower pulleys 32 interleaved by upper pulleys 31 and followed by the output capstan 34.

A load cell 35 is, as an example, fixed to one of the upper pulleys 31 or the lower pulleys 32 to measure a tension value of the optical fiber 2 in the proof test system 160. Particularly, the measured tension value can be provided to the controller 6.

Furthermore, the proof test system 160 comprises a fiber break cell 36 configured to detect an online break of the optical fiber 2 and, in this case, send a corresponding signal to the controller 6 which can initiate a quick stop of the optical fiber shipping towards the take-up apparatus 130. As an example, such quick stop can be performed in no more than 200 ms, considering a speed of 1600 m/min of the optical fiber shipping. The stop of optical fiber shipping is obtained by interrupting/braking the rotation of the draw spool 1, the input capstan 29, the output capstan 34. It is also observed that above stop/braking procedure shows the advantage of avoiding the undesired whipping effect that can occur when the optical fiber breaks.

The output capstan 34 is provided with a respective drive motor (not shown) that operates under the control of the controller 6 which takes into consideration tension values measured by the load cell 35. Typically, the output capstan 34 turns faster than the input capstan 29. Particularly, another numerical counter (not shown) is arranged between the output capstan 34 and the corresponding drive motor to measure the length of optical fiber 2 that is spooling.

Furthermore, the proof test system 160 may comprise an anti-whipping assembly 140 and a take-up dancer 150 arranged between the anti-whipping assembly 140 and the take-up apparatus 130.

The anti-whipping assembly 140 comprises at least one accumulator pulley 37 guiding the optical fiber 2 existing the output capstan 34. The anti-whipping assembly 140 is designed to avoid a whipping effect at the take-up apparatus 130 that could occur when the optical fiber 2 breaks in the test apparatus 120. The accumulator pulleys 37 cause the fiber end to rotate whilst giving time for stopping the operating of the take-up apparatus 130.

The take-up dancer 150, including at least one dancer pulley 38, is configured to set the tension of the optical fiber 2 in the take-up apparatus 130. The angular positions of the dancer pulleys 38 are used by the controller 6 to synchronise the speed of a motor of the take-up apparatus 130 and the speed of the output capstan 34.

The take-up apparatus 130 comprises a shipping spool 39 around which the optical fiber 2 is to be wound and defining a further longitudinal axis Y. The shipping spool 39 can be rotated around said further longitudinal axis Y by a respective drive motor controlled by the controller 6. Moreover, the take-up apparatus 130 is provided with a movable take-up arm 40 which is configured to be engaged with the optical fiber 2 and is movable parallel to further longitudinal axis Y in opposite directions.

According to an example, the movable take-up arm 40 comprises a further slip 41 and a first shipping pulley 42 mechanically connected to the further slip 41. In accordance with such example, the first shipping pulley 8 is rotatable around an axis perpendicular to the further longitudinal axis Y. Particularly, the movable take-up arm 40 is also provided with a second shipping pulley 43 mechanically connected to the further slip 41 and rotatable around an axis parallel to the further longitudinal axis Y.

The take-up apparatus 130 includes a take-up move assembly 44 which comprises a take-up motor 45 connected to a further linear actuator, such as an example, a ball screw, comprising a further screw 46 (or another guide) on which the further slip 41 can translate.

Preferably, the take-up apparatus 130 is provided by at least one anti-static nozzle 47 configured to reduce the amount of electrical static charge generated by the moving optical fiber 2 and/or the rotation of the shipping spool 39. As it is known, an anti-static nozzle produces a stream of ionized compressed air to neutralize static on surfaces and effectively blow-off particles.

The proof test system 160 can be used to test the mechanical strength of an optical fiber 2. The proof test system 160 allows removing fiber portions that show a low quality and transfer the optical fiber unwound from the draw spool 1 onto more than one shipping spool 39, in accordance with specific need. As an example, the shipping spool 39 is adapted for fiber length comprised between 25 km and 50 km while the draw spool 1 is in general adapted for a fiber length between 5 km and 800 km.

The proof test system 160 is configured for applying a specified tensile load to continuous lengths of the optical fiber 2, according to a proof test cycle. The tensile load is applied for a short time as possible, yet sufficiently long to ensure the glass of the fiber experiences the proof stress.

The test can be performed according the standard IEC 60793-1-30 which fixes a proof test level with 1% elongation for 1 second. To reach that conditions a force applied to the optical fiber is of 0.72 Gpa (100 Kpsi). The force is applied to the optical fiber by means of turning the output capstan 34 faster than the input capstan 29. The force applied is controlled and adjusted by means of the load cell 35.

It is noticed that the pay-off system 100 provided with the position detection 50 allows efficiently performing the proof test cycle by the proof test system 160, avoiding any damage of the optical fiber cladding and reaching a high level of automation of the proof test cycle.

Moreover, contrary to the known system employing a pay-off device having two optical sensors detecting the fiber passage in front of them, the optical fiber pay-off apparatus above described does not have performances depending on the fiber colors but it can efficiently operate with optical fibers having any possible distinguishing color. This allow to avoid adjustment of the proximity sensor when the fiber color change and reduce maintenance activities of the apparatus.

What is claimed is:

1. An optical fiber handling system comprising:

a draw spool around which an optical fiber is wound and defining a longitudinal axis;

a pay-off arm movable parallel to the longitudinal axis and engaged with a pay-off portion of the optical fiber;

a controller configured to receive first and second position signals and instruct the pay-off arm to selectively move in a first direction and in an opposite second direction;

first and second proximity sensors mounted on the pay-off arm;

a tilting support rotatably mounted on the pay-off arm;

an activation body fixed to the tilting support and extending along a first direction between the first and second proximity sensors to be selectively detected by the first and second proximity sensors according to positions assumed by the tilting support; and first and second contacts fixed to the tilting support and defining an intermediate space in which the pay-off portion can move, wherein the first and the second contacts comprise a first discrete rod-shaped bar and a second discrete rod-shaped bar that are separated from each other by a gap, wherein the first discrete rod-shaped bar and the second discrete rod-shaped bar are not connected to each other and are each independently and separately fixed to the tilting support at respective spaced-apart mounting locations on the tilting support, and wherein the first discrete rod-shaped bar and the second discrete rod-shaped bar extend from the tilting support in a direction opposite to the first direction of the activation body; and wherein the tilting support is rotatable under a corresponding action of the pay-off portion on the first and the second contacts and configured to selectively assume:

a first detection position in which the activation body is detected by the second proximity sensor which generates a position signal, and a second detection position in which the activation body is detected by the first proximity sensor which generates a further position signal.

2. The system of claim 1, wherein the first and second proximity sensors respectively include one or more sensor devices selected from a group comprising inductive sensor, optical sensor, capacitive sensor, and magnetic sensor.

3. The system of claim 1, wherein the controller is configured to:

alternatively receive the position signal and the further position signal and instruct the pay-off arm to selectively move in the first direction and in the opposite second direction in order to reach a position in which the activation body is not detected by either the first proximity sensor or the second proximity sensor.

4. The system of claim 1, further including:

a base structure supporting the first and second proximity sensors and the tilting support.

5. The system of claim 4, wherein the pay-off arm comprises:

a movable slip arranged to be translated parallel to the longitudinal axis; the base structure being mechanically connected to the movable slip; and at least a first pulley mechanically connected to the movable slip to guide an unwinding of the pay-off portion from the draw spool.

6. The system of claim 5, further comprising a move assembly configured to move the movable pay-off arm in the first and the second directions and having:

a linear actuator connected to the movable slip; and a motor mechanically connected to the linear actuator to move the movable slip and configured to be controlled by the controller.

7. The system of claim 5, wherein:

the base structure comprises a support plate on which the tilting support and the first and second proximity sensors are fixed and a connection plate mechanically connected to the movable slip.

8. The system of claim 7, wherein the tilting support comprises:

a pivot fixed to the base structure; and a rotatable pad mounted to the base structure by the pivot.

9. The system of claim 8, wherein:

the activation body is rod-shaped and extends from a first side portion of the rotatable pad towards a gap region formed between the first and second proximity sensors; and the first and second contacts extend from a second side portion of the rotatable pad separated from the first side portion by the pivot.

10. The system of claim 1, configured to operate as proof test system of the optical fiber, the proof test system comprising:

a test apparatus configured to subject the optical fiber unwound from the draw spool to a proof test procedure; and a take-up apparatus configured to wind the optical fiber exiting the test apparatus onto a shipping spool.

11. The system of claim 10, wherein the test apparatus comprises: an input capstan provided by a first drive motor and an output capstan provided by a second drive motor and a plurality of intermediate pulleys, and wherein the input capstan, the plurality of intermediate pulleys and the output capstan are configured to guide the optical fiber and apply a force to the optical fiber depending on rotation velocities of the output capstan and the input capstan.

12. The system of claim 11, wherein the test apparatus comprises:

a load cell configured to measure a tension value associated with the optical fiber in the test apparatus.

13. The system of claim 11, wherein the test apparatus further comprises:

a fiber break cell configured to detect a break of the optical fiber and send a corresponding break detection signal to the controller, wherein the controller is configured to initiate a stop of a movement of the optical fiber towards the take-up apparatus based on the break detection signal.

14. The system of claim 11, wherein the take-up apparatus comprises:

a movable take-up arm which is configured to be engaged with the optical fiber and move parallel to a further longitudinal axis defined by the shipping spool.

15. The system of claim 10, wherein the test apparatus comprises an input capstan and an output capstan, the system further comprising:

an anti-whipping assembly having at least one accumulator pulley guiding the optical fiber exiting the output capstan.

16. A position detection device comprising:

a base structure;

a first proximity sensor and a second proximity sensor mounted on the base structure;

a pivot fixed to the base structure;

a tilting support rotatably mounted on the base structure by the pivot and having a first end portion and a second end portion that are on opposite sides with respect to the pivot;

an activation body fixed to the first end portion of the tilting support and extending along a first direction between the first and second proximity sensors to be selectively detected by the first and second proximity sensors according to positions assumed by the tilting support; and first and second contacts fixed to the second end portion of the tilting support and defining an intermediate space in which an optical fiber portion can move, wherein the first and the second contacts comprise a first discrete rod-shaped bar and a second discrete rod-shaped bar that are separated from each other by a gap, wherein the first discrete rod-shaped bar and the second discrete rod-shaped bar are not connected to each other and are each independently and separately fixed to the tilting support at respective spaced-apart mounting locations on the tilting support, and wherein the first discrete rod-shaped bar and the second discrete rod-shaped bar extend from the tilting support in a direction opposite to the first direction of the activation body; and wherein the tilting support is rotatable under a corresponding action of the optical fiber portion on the first and the second contacts and is configured to selectively assume:

a first detection position in which the activation body is detected by the second proximity sensor, and a second detection position in which the activation body is detected by the first proximity sensor.

17. The position detection device of claim 16, wherein the first and second proximity sensors respectively include a sensor device comprising an inductive sensor, an optical sensor, a capacitive sensor, or a magnetic sensor.

18. The position detection device of claim 16, wherein the tilting support comprises a rotatable pad mounted to the base structure by the pivot.

19. The position detection device of claim 18, wherein the activation body is rod shaped and extends from a first side portion of the rotatable pad towards a gap region formed between the first and second proximity sensors; and wherein the first and the second contacts extend from a second side portion of the rotatable pad separated from the first side portion by the pivot.

20. A proof test system for an optical fiber, the system comprising:

a pay-off system comprising:

a draw spool around which the optical fiber is wound and defining a longitudinal axis;

a pay-off arm movable parallel to the longitudinal axis and engaged with a pay-off portion of the optical fiber;

a controller configured to receive position signals and instruct the pay-off arm to selectively move in opposite directions;

a position detection device comprising:

a base structure mounted on the pay-off arm;

first and second proximity sensors mounted on the base structure;

a tilting support rotatably mounted on the base structure by a pivot;

an activation body fixed to a first portion of the tilting support and extending along a first direction between the first and second proximity sensors; and first and second rod-shaped contacts fixed to a second portion of the tilting support and separated from each other to define an intermediate space in which the pay-off portion of the optical fiber moves, wherein the first and the second rod-shaped contacts comprise a first discrete rod-shaped bar and a second discrete rod-shaped bar that are separated from each other by a gap, wherein the first discrete rod-shaped bar and the second discrete rod-shaped bar are not connected to each other and are each independently and separately fixed to the tilting support at respective spaced-apart mounting locations on the tilting support, and wherein the first discrete rod-shaped bar and the second discrete rod-shaped bar extend from the tilting support in a direction opposite to the first direction of the activation body;

a test apparatus configured to subject the optical fiber unwound from the draw spool to a proof test procedure, the test apparatus comprising:

an input capstan driven by a first drive motor;

an output capstan driven by a second drive motor; and a plurality of intermediate pulleys between the input and the output capstans;

a fiber break cell configured to detect a break of the optical fiber and send a corresponding break detection signal to the controller; and a take-up apparatus configured to wind the optical fiber exiting the test apparatus onto a shipping spool; and wherein the controller is configured to initiate a stop of movement of the optical fiber towards the take-up apparatus based on the break detection signal.

* * * * *